US006945011B2

(12) United States Patent
Hidding et al.

(10) Patent No.: US 6,945,011 B2
(45) Date of Patent: Sep. 20, 2005

(54) CONTAINER CLOSURE SYSTEM

(75) Inventors: Douglas J. Hidding, Barrington Hills, IL (US); Joseph E. Bashour, New Castle, PA (US)

(73) Assignee: Blackhawk Molding Co., Inc., Addison, IL (US)

( * ) Notice: Subject to any disclaimer, the term of this patent is extended or adjusted under 35 U.S.C. 154(b) by 0 days.

(21) Appl. No.: 10/447,990

(22) Filed: May 29, 2003

(65) Prior Publication Data

US 2004/0237471 A1 Dec. 2, 2004

(51) Int. Cl.[7] ..... B65B 7/28; B65B 55/24
(52) U.S. Cl. ..... 53/167; 53/331.5
(58) Field of Search ..... 53/167, 317, 331.5, 53/355

(56) References Cited

U.S. PATENT DOCUMENTS

| | | | | | |
|---|---|---|---|---|---|
| 2,176,133 | A | * | 10/1939 | Hogg | 53/347 |
| 2,835,093 | A | * | 5/1958 | Ford et al. | 53/345 |
| 3,303,633 | A | * | 2/1967 | Wilhere | 53/317 |
| 3,434,266 | A | * | 3/1969 | Wolf et al. | 53/353 |
| 3,578,038 | A | | 5/1971 | Burford | 141/7 |
| 3,771,284 | A | | 11/1973 | Boeckmann et al. | 53/282 |
| 3,871,425 | A | | 3/1975 | Fee et al. | 141/5 |
| 3,892,264 | A | | 7/1975 | Held | 141/5 |
| 3,906,706 | A | * | 9/1975 | Conti | 53/331.5 |
| 3,984,965 | A | * | 10/1976 | Sonnenberg | 53/331.5 |
| 4,389,833 | A | * | 6/1983 | Knabe | 53/167 |
| 4,527,377 | A | * | 7/1985 | Hayashi et al. | 53/167 |
| 4,905,447 | A | * | 3/1990 | Margaria | 53/317 |
| 5,040,354 | A | * | 8/1991 | Ahlers et al. | 53/167 |
| 5,150,558 | A | * | 9/1992 | Bernhard | 53/167 |
| 5,197,258 | A | * | 3/1993 | Johanek | 53/317 |
| 5,220,767 | A | * | 6/1993 | de Santana | 53/331.5 |
| 5,235,793 | A | * | 8/1993 | Heudecker | 53/167 |
| 5,473,855 | A | | 12/1995 | Hidding et al. | 53/314 |
| 5,884,450 | A | * | 3/1999 | Ronchi | 53/317 |
| 6,170,232 | B1 | * | 1/2001 | VandeGeijn | 53/331.5 |

* cited by examiner

*Primary Examiner*—John Sipos
(74) *Attorney, Agent, or Firm*—David I. Roche; Baker & McKenzie LLP

(57) ABSTRACT

A system for sealing threaded containers. The system includes a clutch-free spindle assembly which is easily disassembled and cleaned. The special interface between the exterior surface of the cap an the gripping jaws of the chuck allow the system to operate without the moving parts and complications that attend the use of clutch. The spindle assembly features an easily adjustable stop arm and a quick release pin for removing and cleaning the chuck. The chuck has several passageways for the rapid infusion of cleaning fluid.

7 Claims, 4 Drawing Sheets

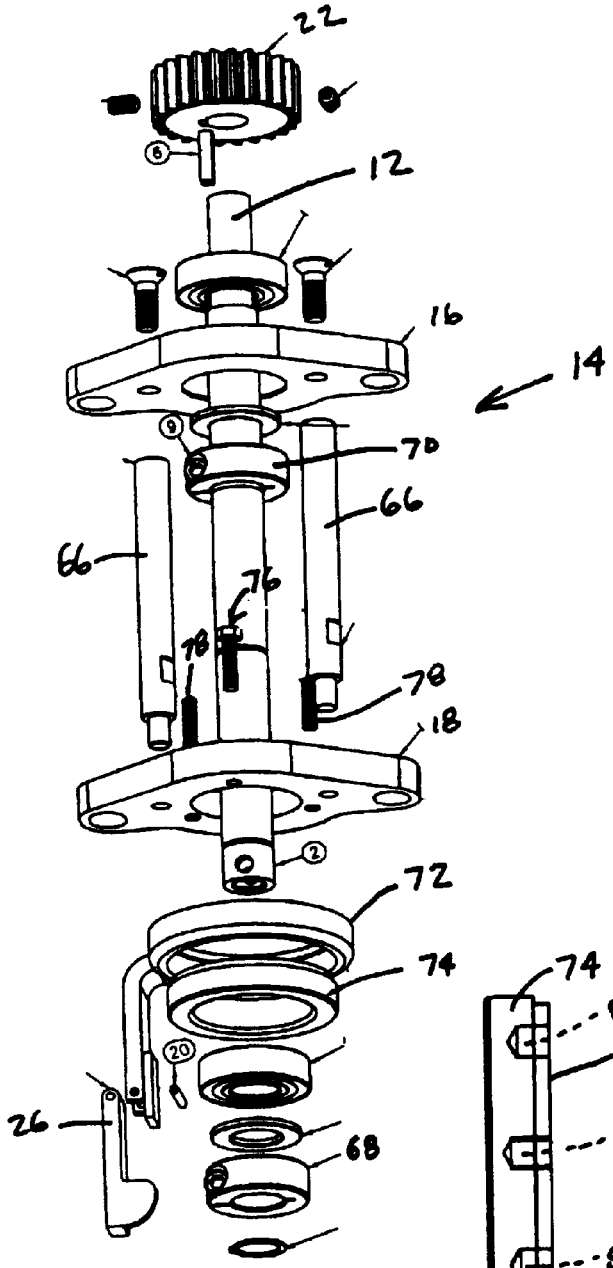
Fig. 4
Fig. 4A
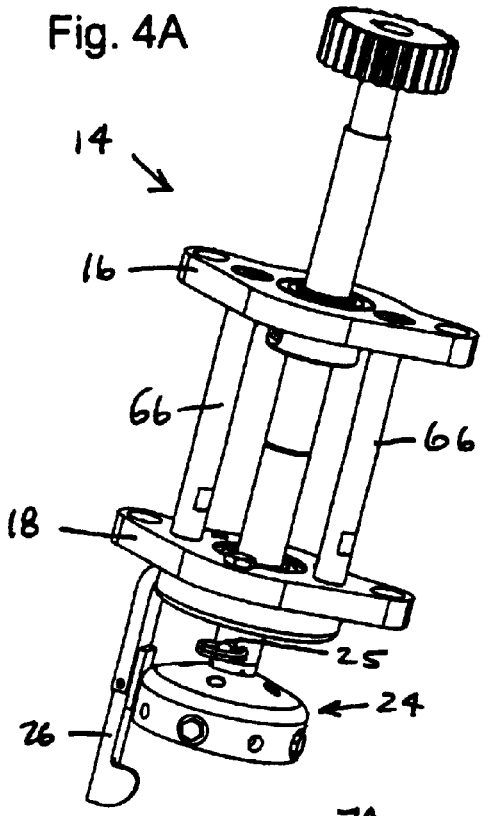
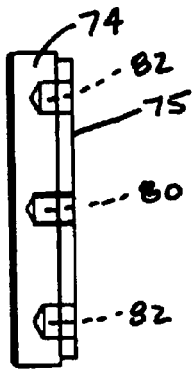
Fig. 5
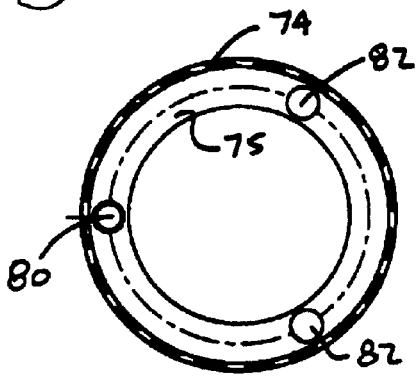
Fig. 6

CONTAINER CLOSURE SYSTEM

BACKGROUND AND SUMMARY OF THE INVENTION

Machines for applying closures to containers are well known and widely used. The present invention relates to the application of threaded closures to containers having threaded necks, and is particularly directed to the application of closures to containers which hold consumable liquids, such a milk.

It is nearly impossible with practical cleaning systems to remove all milk residues and deposits from the milk contact surfaces of milk bottling and capping equipment. One of the major difficulties with most currently used equipment, closures and containers, is the need to thoroughly and frequently clean the equipment so that the contents of the containers is not contaminated.

Overtightening or stripping of the threaded connection between the closure and the container is also a problem. Applying threaded closures to milk containers is particularly problematic because milk is lubricious, making stripping a significant problem in milk bottling operations.

Many bottlers, for convenience and to reduce costs associated with shipment of empty containers, blow mold containers on-site. Because many bottlers do not have expertise in blow molding operations and, in particular, tooling maintenance, serious problems can arise, such as bottles being molded to configurations which significantly vary over time. In some instances, bottlers have other difficulties maintaining consistent quality in the manufacture of their bottles. Problems such as excessive flash, mismatching of mold components, excessive parison pleating, and non-round openings are common in on-site blow molding operations. While caps are generally molded to relatively precise and consistent dimensions, blow molded bottles generally are not, particularly bottles made by bottlers who blow mold bottles on-site. To provide a reliable closure on bottles of varying dimensions and quality is a difficult challenge for cap suppliers.

The present inventions have particularly beneficial application in turret-type capping equipment of the general type shown and described in the following U.S. Pat. Nos. 3,771,284; 5,197,258; and 5,473,855. However, the spindle assembly and related rotation inducing equipment could be used in other types of machinery. When used with turret-type machinery, a cap feeder assembly is used to bring a cap into initial proximity to a moving container neck. A conveyer brings the container into engagement with the cap and delivers the container (with the cap loosely disposed atop the container) to a capping station on the turret. The container support of the turret holds the container in vertical alignment with a spindle assembly. When the container support engages a cam, the container (with a cap loosely positioned on the container neck) is lifted into engagement with a chuck at the lower end of a drive shaft of the spindle assembly. The drive shaft of the spindle assembly has a chuck carried by the lower portion of the spindle, which grips the cap as the bottle and cap are brought into engagement with the chuck.

When the turret rotates, a pinion gear at or near the upper end of the drive shaft of the spindle assembly delivers torque to the drive shaft due of the engagement of the pinion gear with a stationary and much larger gear wheel mounted atop the turret. In a typical turret capping machine the gear wheel is continuous. However, as shown in U.S. Pat. No. 5,473,855, the gear wheel may be less than a full circle, and torque may be delivered to the drive shaft intermittently. The interface where torque is transferred from gripping jaws on the chuck to knurls formed on the outside surface of the cap (i.e., the chuck/cap interface) is designed to prevent stripping of the cap as it is tightened onto the threads of the container.

In one embodiment described herein, a cap is designed to have a series of areas where some of the knurls on the exterior of the skirt portion of the cap extend radially outwardly beyond other knurls, such that the extended knurls are the primary points of contact with the gripping jaws of the chuck. If the cap tightens before the spindle assembly stops rotating, the extended knurls deflect and allow continued rotation of the chuck, even though the cap has stopped rotating, thus preventing the stripping of the threads of the cap relative to the threads on the container neck.

Thus, the knurls on the cap and splines on the jaws inside the chuck as described herein are specifically designed to simplify and facilitate the application of threaded caps to threaded containers. The chuck/cap interface described and claimed herein is designed to reduce the number of moving and fixed parts by eliminating the need for a clutch mechanism in a capping spindle. This objective is achieved the a chuck and cap combination that includes a very simple and easily cleaned chuck and a cap with a specially designed surface that is contacted by the jaws of the chuck.

Furthermore, the simplicity of chuck described and claimed herein significantly reduces down time needed to clean and disinfect the capping machine and reduces the chance of unwanted bacteria from making its way into any bottles.

These and other objects and advantages of the present invention will be better understood upon a reading of the following specification read in conjunction with the accompanying drawings.

BRIEF DESCRIPTION OF THE DRAWINGS

FIG. 4 is an exploded perspective view of a spindle assembly made in accordance with the present inventions;

FIG. 4A is an assembled perspective view of the spindle assembly shown in FIG. 4 with a chuck attached;

FIG. 5 is a side elevational view of a ring forming a part of the spindle assembly shown in FIGS. 4 and 4A;

FIG. 6 is a plan view of the ring shown in FIG. 5;

DETAILED DESCRIPTION OF THE INVENTION

Figure 1:
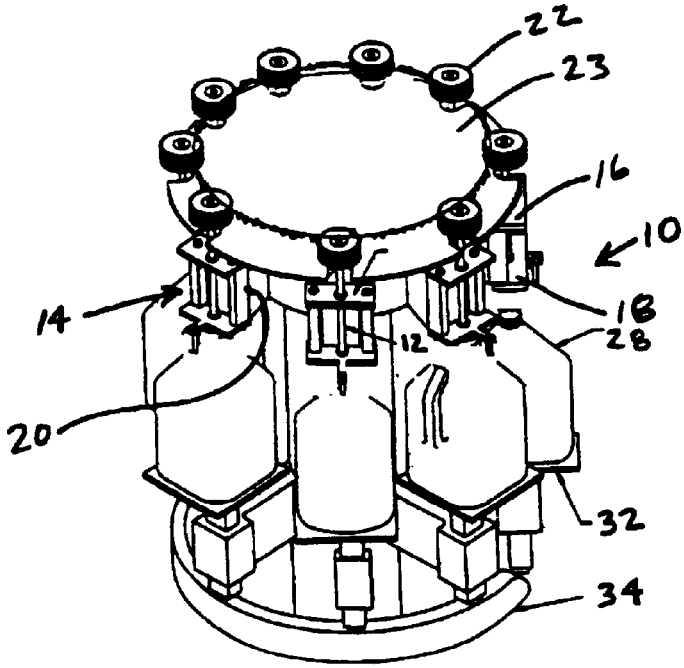
FIG. 1 is a perspective view of a turret with a plurality of spindle assemblies made in accordance with the present inventions.

FIG. 1 shows a turret assembly 10 with several capping stations. Each capping station includes a spindle assembly 14 held in place by a pair of support plates 16 and 18. The spindle assembly includes drive shaft 12 which is held and guided by an upper support plate 16 and a lower support plate 18. The support plates 16 and 18 are connected to the turret assembly 10 by a spindle support arm 20. A small pinion gear 22 is affixed to the upper end of the drive shaft 12, and a chuck 24 (shown in detail in FIGS. 4 and 4A) is connected, by a quick-release pin 25, to the lower end of the drive shaft 12. Attached to the lower support plate 18 is a hinged stop arm 26 which engages the handle of a bottle 28 to prevent rotation of the bottle as a cap 30 (shown in detail in FIGS. 2 and 3) is tightened onto the bottle 28.

As the turret 10 rotates in the direction of the arrow shown in FIG. 1, a bottle support 32, carried by the turret assembly 10, engages a cam 34, and lifts each bottle 28 upward and causes the cap 30 to engage the chuck 24. The pinion gears 22 are in continuous engagement with a large fixed gear wheel 23 which does not rotate with the movement of the turret assembly 10. The engagement between the pinion gears 22 and the gear wheel 23 supplies the torque needed to tighten a cap 30 onto a the threaded neck of a bottle 28.

Figure 2:
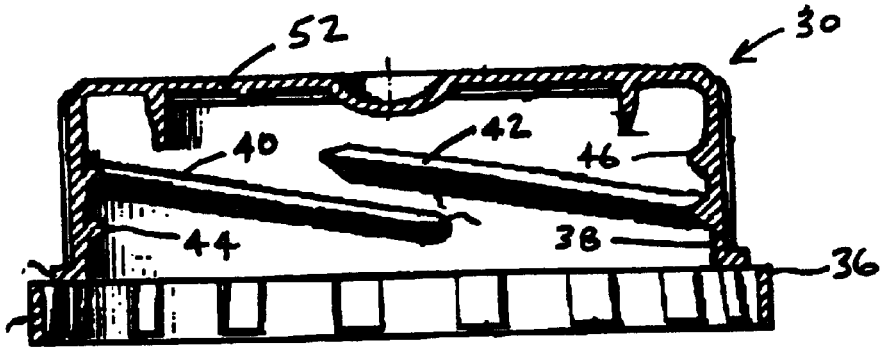
FIG. 2 is a cross-sectional view of a cap suitable for use in connection with the present inventions.

FIG. 2 is a cross-sectional view of a cap 30 having a ratchet ring 36 extending from the bottom portion of a skirt 38. The cap 30 has four threads, 40, 42, 44 and 46, all of which are at least partially visible in FIG. 2. The cap 30 includes an integral plug 48 which has a conical exterior.

Figure 3:
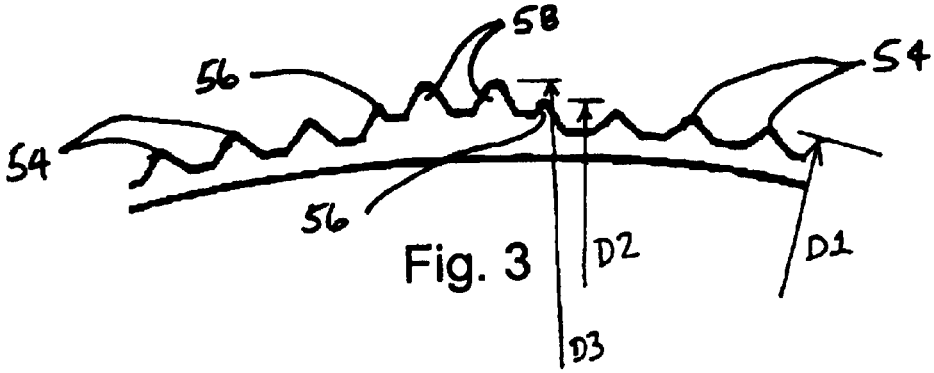
FIG. 3 is an enlarged plan view of knurls on the exterior of a cap made in accordance with the present inventions.

FIG. 3 is an enlarged plan view of knurls 50 which extend generally in a vertical direction from the lower portion of the skirt 38 to a point near the top 52 of the cap 30. The knurls 50 include three different kinds of knurls, i.e., a series of several inner knurls 54 extending a first radial distance D1 from the center of the cap; intermediate knurls 56 extending a second radial distance D2 from the center of the cap; and outer knurl 58 extending a third radial distance D3 from the center of the cap. Two outer knurls 58 are adjacent to one another, and are flanked by an intermediate knurl 56 on each side of the pair of outer knurls 58. The combination of two outer knurls 58 and two intermediate knurls 56 define a region 60 of primary jaw engagement. There twelve regions 60 of primary jaw engagement equally spaced around the circumference of the 30 cap.

FIGS. 4 and 4A are exploded and assembled views, respectively, of a spindle assembly 14. A drive shaft 12 extends down the center of the spindle assembly 14 and is supported by an upper plate 16 and a lower plate 18. A pair of standoffs 66 separate the plates 16 and 18. A pinion gear 22 is rigidly affixed to the upper end of the drive shaft 12. FIG. 4A shows a chuck 24 connected to the lower end of the drive shaft 12 by a quick release pin with a ring at one end.

The drive shaft 12 is held in place by a lower lock collar 68 which connects to the drive shaft 12 below the lower surface of the lower plate 18. An upper lock collar 70 is attached to the drive shaft 12 at a location which is adjacent to the underside of the upper plate 16. The lock collars 68 and 70 resist upward forces applied to the drive shaft 12 when a cap 30 is brought into engagement with the chuck 24, which occurs when a bottle 28 (with a cap loosely carried atop the bottle) is lifted by the cam 34.

A hinged stop arm 26 is supported by an outer ring 72. The outer ring 72 is held in place below the lower plate 18 by an inner ring 74. The inner ring 74 is connected to the lower plate 18 by a single bolt 76 and a pair of dowel pins 78. The ring 74 is prevented from rotating by the bolt 76 and the dowel pins 78. This arrangement allows for quick adjustment of the rotational position of the stop arm 26, because the bolt 76 is on the outwardly facing side of the lower plate 18 and is therefore easily accessible by a service person. Loosening the bolt 76 will allow the entire inner ring 74 to drop and release the grip that it has on the outer ring 72 so that the stop arm 26 may be positioned at any radial position around the drive shaft 12. The stop arm 26 is intended to engage the handle on a container to prevent the container from rotating as the drive shaft 12 and chuck 24 apply torque to a cap on the container.

FIGS. 5 and 6 show details of the inner ring 74. The upper surface 75 of the inner ring 74 has three holes, a first threaded hole 80 and two unthreaded holes 82. The unthreaded holes 82 are intended to engage the dowel pins 78 while the threaded hole 80 is intended to engage the bolt 76 when the ring 74 is attached to the underside of the lower plate 18 in combination with the outer ring 72.

Figure 7:
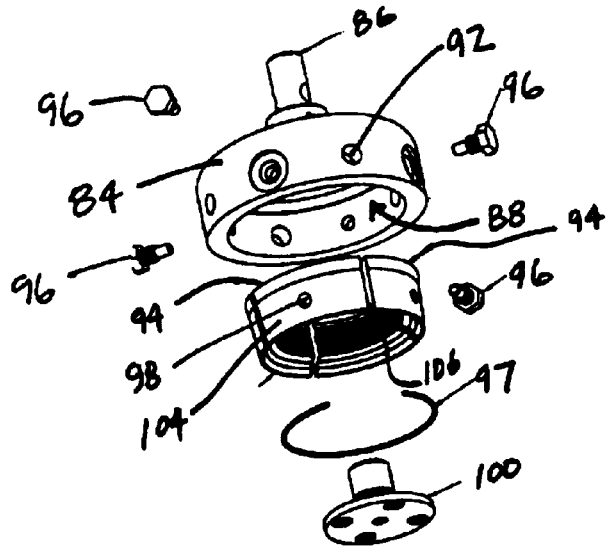
FIG. 7 is an exploded view of a chuck made in accordance with the present inventions.
Figure 8:
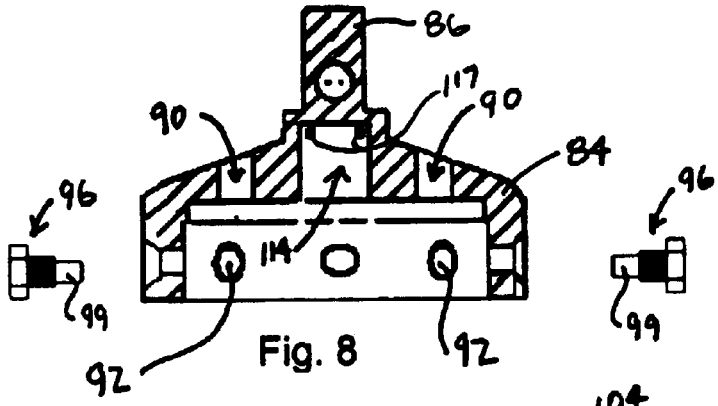
FIG. 8 is a cross-sectional view of the chuck housing shown in FIG. 7.

FIGS. 7 and 8 show the chuck 24. A chuck housing 84 has a stem 86 with a through hole for receiving the quick release pin 25. A main recess 88 is formed at a lower side of the chuck 24. Four equally spaced passageways 90 extend through the upper portion of the chuck housing 84. Similarly, the chuck housing 84 has a series of four lateral passageways 92 which extend through the outer portion of the chuck housing 84. The passageways 90 and 92 allow for the free flow of cleaning fluid so that the chuck housing may be cleaned completely and quickly.

Four cap gripping jaws 94 fit into the main recess 88 in the chuck housing 84. Each jaw 94 is held in the main recess 88 by a combination of pivot screws 96, which extend with some clearance into bores 98 formed in the outside wall of each jaw, and C-shaped spring 97. One pivot screw 96 provides vertical support for each jaw 94, the spring 97 urges all of the jaws radially outwardly so as to keep the each jaw in engagement with its respective pivot screw 96. Each of four pivot screws 96 extends through the outer wall of the chuck housing 84 such that an unthreaded portion 99 extends inwardly from the inner wall of the chuck housing and into a bore 98 formed on the outer surface of each gripping jaw 94. The bore 98 extends into but not through the cap gripping jaw 94. The diameter of the unthreaded end 99 of the pivot screw 96 is somewhat smaller than the diameter of the bore 98 such that each gripping jaw may pivot repeatedly about the unthreaded portion of the pivot screw 96 by which the jaw is supported without binding.

Figure 9:
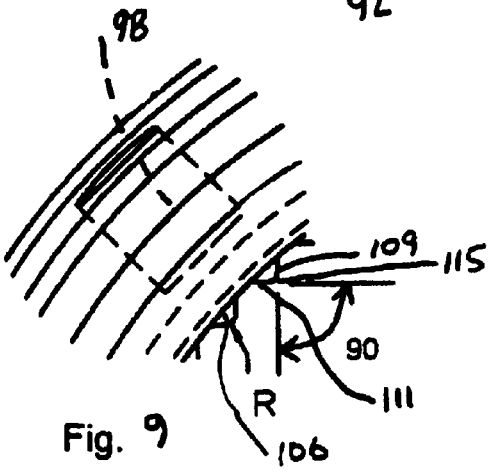
FIGS. 9 and 10 are enlarged end views of a jaw of the chuck shown in FIG. 7.
Figure 10:
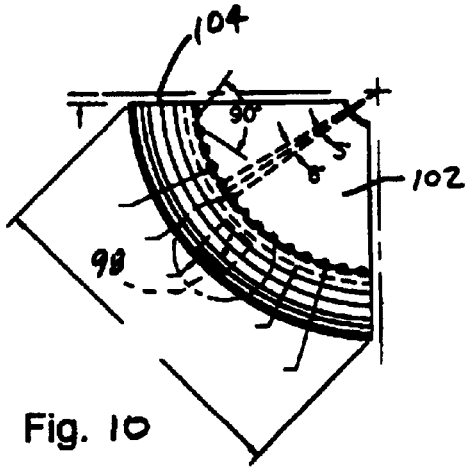
Figure 11:
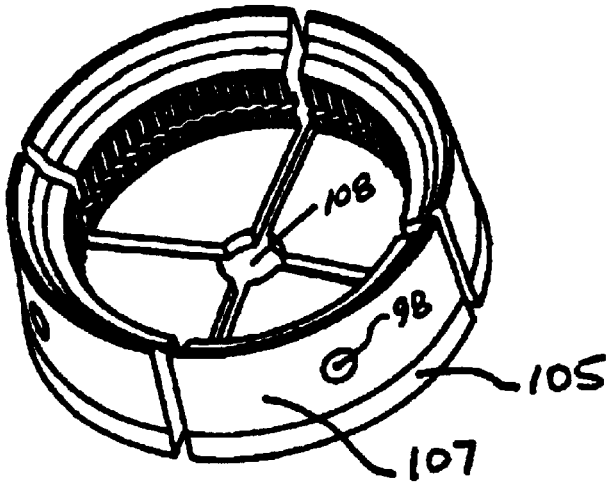
FIG. 11 is a perspective view of the set of four jaws shown in FIG. 7.
Figure 12:
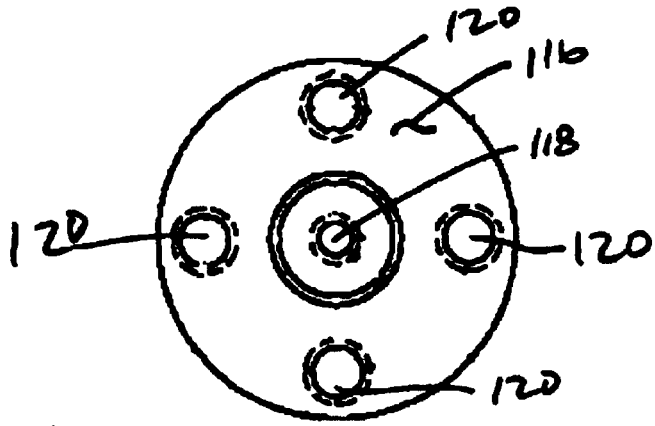
FIG. 12 is a plan view of an actuator which is part of the chuck shown in FIG. 7.
Figure 13:
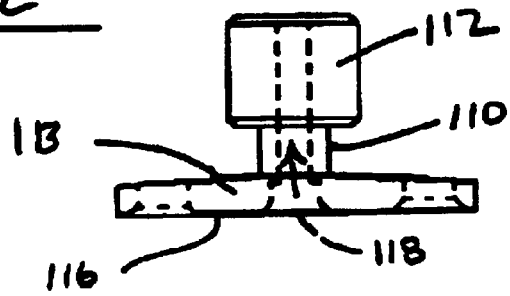
FIG. 13 is a side elevational view of the actuator shown in FIG. 11

FIGS. 7, 12 and 13 show a jaw actuator 100 which is used to cause the jaws 94 (See FIG. 7) to pivot together, respectively, about the pivot screws 96 which support the jaws 94. As can be seen in FIGS. 7, 9 and 10, each jaw 94 has an upper quadrant shaped plate-like section 102 which extends radially inwardly from a vertical wall 104. Wall 104 is generally cylindrical in shape and has vertical splines 106 spaced at about 6 degrees on center. Each spline 106 is preferably comprised of two main longitudinal surfaces 109 and 111, which are disposed at about 90 degrees from each other, and which are joined by a rounded surface 115 having a radius ("R" in FIG. 9) of about 0.015 inches. The splines 106 preferably extend inwardly from the inside surface of the jaw a distance of about 0.04 inches.

The interaction between the knurls 58, 56 and 54 (the outer knurls 58 in particular) and the splines 106 is important in that this chuck/cap interface eliminates the need for a complex clutch mechanism. The splines (particularly when the cap is made of low density polyethylene—LDPE) give way and allow slippage of the chuck at about 35 inch-pounds of torque, when a four-thread cap like the one shown in FIG. 2 is used on a blow-molded container neck. A four thread cap is preferred because with such a cap only a small amount of rotation is required to tighten the cap on to the bottle neck. The rounded shape of the inner tips of the splines and the rounded shape of the tips of the knurls produces a minimum amount of visible marring on the knurls, even when high density polyethylene—HDPE is used to make the cap. The relative spacing as well as the shape of the knurls and splines is also an important factor in achieving a repeatable torque of about 35 inch-pounds, and not much more than that. In the embodiment cap show in FIG. 2 and the jaws shown in FIGS. 7, 9, 10 and 11, there is an integral-multiple relationship of the circumferential spacing of the splines 106 and the regions 60 of primary cap engagement. In particular, by way of example, the splines are spaced at 6 degrees, while there are twelve regions 60 of primary cap engagement, i.e. a frequency of one every 30 degrees. Thus the frequency of regions 60 to splines 106 is 30:6 or 5.

The upper quadrant shaped plate-like section 102 of each jaw 94 is preferably disposed at a slight angle (about 4 degrees) with respect to horizontal, and the outside surface of the wall 104 is comprised of two conical sections, including an upper conical section 105 making an angle of about 83 degrees with respect to horizontal, and an axially longer lower conical section 107 disposed at about 86½ degrees from horizontal.

The four upper quadrant shaped plate-like sections 102 of the gripping jaws 94 converge to define a central opening 108 which is slightly larger in diameter than the neck 10 of the jaw actuator 100. The jaw actuator 100 includes a guide piston 112 which fits closely, but moves freely, within a guide cylinder 114 in the chuck housing 84.

The guide piston 112 is joined to an actuator plate 113 by a reduced-diameter neck 110. A central core passageway 118 extends from the upper end of the guide piston 112 to the lower side of the actuator plate 113, such that the passageway 118 passes all the way through the actuator 100 from one end to the other. Small vent holes 117 are formed in the upper end of the guide cylinder 114 to avoid pressure variations within the guide cylinder 114 resulting from movement of the guide piston 112 in the guide cylinder 114. A set of holes 120 are formed in the actuator plate 113, and the holes 120 together with the central opening 118 form pathways for the free flow cleaning fluid, making the actuator, the chuck housing 84 and the jaws 94 easy to keep clean.

As a container with a cap loosely fitted onto the neck thereof is brought upwardly into engagement with the chuck 24, the cap on the container contacts the lower surface 116 of the jaw actuator 100. As the cap and container continue to be pushed upwardly, and with the chuck turning constantly (or intermittently, depending upon the design of the turret) the jaw actuator 100 causes the jaws 94 to pivot about the pivot screws 96 such that the upward force of the cap and container result in a lateral gripping force exerted by the jaws 94 on the splined surfaces of a cap 30 (See FIG. 2). Thus, each jaw is urged outwardly to a first "jaws open" position by the spring 97 (See FIG. 7). However, when a cap-carrying container is urged upwardly, the actuator 100 causes the jaws to pivot into a second "jaws closed" position. At the same time as this gripping action occurs, rotational force and rotational movement results from the engagement of the pinion gear 22 with the gear wheel 23, as shown in FIG. 1.

While specific embodiments of the inventions have been shown and described, it is believed that numerous alternatives, modifications, and variations of the embodiments shown and described herein may be realized by persons of ordinary skill in the arts to which the inventions pertain, and such persons may devise a number of such alternatives, modifications, and variations of the embodiments shown and described herein without departing from the spirit and scope of the appended claims.

We claim:

1. A capping device comprising:

a drive shaft having an upper part and a lower part, a gear affixed to said upper part, a chuck carried by said lower part, a quick-release coupling connecting said chuck to said lower part; and said chuck comprising:

a housing with a downwardly facing main recess, said recess housing a plurality of jaws defining cap receiving area, each of said jaws being pivotable between a first position and a second position, a spring urging said jaws toward said first position, said chuck housing having open at least one passageway extending through said chuck housing oriented in a manner selected from the group consisting of 1) generally axially extending and 2) in the case of a plurality of passageways, both generally axially and generally laterally extending, said at least one passageway being radially spaced from said quick-release coupling and extending through the chuck housing from the main recess in the housing to an area external to the housing for allowing access to the main recess from outside the housing for cleaning of the housing.

2. A capping device in accordance with claim 1 wherein:

a quick-release coupling connecting said chuck to said lower part; and said quick-release coupling comprises a first transverse hold in a stem extending from an upper surface of said housing, a bore in a lower end of said drive shaft, and a second transverse hole in said drive shaft intersecting said bore, a release pin extendible through said first and second transverse holes.

3. A capping device in accordance with claim 1 wherein:

said housing has at least one passageway extending through an upper surface of said housing, and at least one passageway extending radially inwardly from an outer wall of said housing.

4. A capping device in accordance with claim 1 wherein:

each of said jaws is held in said recess by a pivot pin extending radially inwardly from an inside surface of an outer wall of said housing, said jaw being pivotable about said pin between said first and second positions.

5. A capping device in accordance with claim 1 wherein:

a chuck actuator is disposed in said recess, said actuator having an upper guide surface fitting closely within a guide bore, said guide bore formed in an upper inside surface of said housing, said actuator having a slot receiving a lever arm on said jaws whereby displacement of said actuator causes simultaneous pivoting of said jaws.

6. A capping device in accordance with claim 1 wherein:

said spring is a C-shaped ring, each of said jaw having a groove formed on an inside surface, each groove receiving a portion of said ring, said ring being compressed into engagement with said grooves, whereby said spring urges said jaws into an open position.

7. A capping device in accordance with claim 6 wherein:

said jaws are urged into said first position solely by said spring.

* * * * *